US006161375A

United States Patent [19]

Keenan

[11] Patent Number: 6,161,375

[45] Date of Patent: Dec. 19, 2000

[54] AIR SEPARATION AND COMBINED CYCLE POWER PLANT

[75] Inventor: Brian Anthony Keenan, Surrey, United Kingdom

[73] Assignee: The BOC Group plc, Windlesham, United Kingdom

[21] Appl. No.: 09/131,978

[22] Filed: Aug. 11, 1998

[30] Foreign Application Priority Data

Aug. 15, 1997 [GB] United Kingdom ..... 17348

[51] Int. Cl.[7] ..... F02C 6/18

[52] U.S. Cl. ..... 60/39.182; 60/39.33

[58] Field of Search ..... 60/39.07, 39.12, 60/39.182, 39.33

[56] References Cited

U.S. PATENT DOCUMENTS 4,723,407 2/1988 Goebel et al. ..... 60/39.12

5,394,686 3/1995 Child et al. ..... 60/39.12

*Primary Examiner*—Louis J. Casaregola

*Attorney, Agent, or Firm*—Salvatore P. Pace

[57] ABSTRACT

An air separation plant has a product nitrogen compressor arranged to be driven by a steam turbine adapted to be operated in a cycle in which steam is able to be raised in a steam generator by heat exchange of water with hot gaseous exhaust from a gas turbine.

1 Claim, 1 Drawing Sheet

AIR SEPARATION AND COMBINED CYCLE POWER PLANT

BACKGROUND OF THE INVENTION

This invention relates to an air separation plant.

Air separation plants in which the air is separated by rectification (i.e. fractional distillation) at cryogenic temperatures or by pressure swing adsorption are well known. A product of air separation, for example, oxygen or nitrogen, is often required at elevated pressure. On some occasions, the elevated pressure is greater than that at which the separation is performed. Typically, therefore, the air separation plant may include a product compressor.

U.S. Pat. No. 4,382,366 relates to an oxygen generator in which an oxygen product compressor is directly driven by a steam turbine. A waste nitrogen stream containing sufficient oxygen to support combustion is taken from the rectification column in which the oxygen product is separated and is without further compression introduced into a chamber in which combustion of a fuel gas takes place. The resultant combustion products are expanded in a turbo-expander. The stream supplied to the steam turbine is raised by heat exchange with the combustion gases exhausted from the turbo-expander. The oxygen product compressor, the air compressor of the oxygen generator, the steam turbine and the turbo-compressor are all coupled together. Such a plant cannot produce a nitrogen product in large quantities.

Air separation plant in which a single nitrogen product is produced at a rate of over 1000 tones per day at elevated pressure is well known. A large product nitrogen compressor is therefore required. Such a nitrogen compressor is conventionally driven by an electrical motor.

The need sometimes arises to vary the pressure at which the nitrogen product is produced. An example of such a need is in the nitrogen-enhanced recovery of oil or gas from, respectively, an oil field or a gas field. A large product nitrogen compressor driven by an electrical motor is relatively inflexible and is not readily suited to supplying the product at the different pressures that are typically needed over a prolonged period of time for the recovery of oil or gas.

An aim of the present invention is to provide an air separation plant which has an alternative means of driving a product nitrogen compressor better able to cope with a varying pressure demand.

SUMMARY OF THE INVENTION

According to the present invention there is provided an air separation plant including a product nitrogen compressor arranged to be driven by a steam turbine adapted to operate in a cycle in which steam is able to be raised by heat exchange of water with hot gaseous exhaust from a gas turbine.

The air separation plant according to the invention offers a number of advantages. First, a steam turbine may readily be ramped up and down in order to vary the outlet pressure of the product compressor. Secondly, with a steam turbine drive there is no need for an electrical motor to start up the product compressor. Thirdly, by employing exhaust gas from a gas turbine to raise the steam, relatively efficient steam raising is made possible in comparison with the use of a boiler which is directly heated by burning a fuel.

The gas turbine is preferably adapted to drive an electrical generator arranged to supply electric power to a motor operatively associated with an air compressor forming part of the air separation plant.

The air separation plant typically additionally includes adsorption apparatus for removing water vapor and carbon dioxide from the air, a heat exchanger for reducing the air to a temperature at which it is able to be separated by rectification, at least one rectification column for separating nitrogen from the air, and at least one turbo-expander for generating refrigeration. Preferably, the rectification column is a double rectification column comprising a higher pressure stage, a lower pressure stage, and a condenser-reboiler thermally linking an upper region of the higher pressure stage to a lower region of the lower pressure stage, the arrangement being such that, in operation, the condenser provides reflux for both stages of the double rectification column. If desired, in order to maximise the average pressure at which nitrogen is taken from the rectification column, a stream of gaseous nitrogen may be taken from both the lower pressure stage and the higher pressure stage. In order to enhance the rate at which reflux is produced, a part of the nitrogen vapor taken from the lower pressure stage may be condensed and fed back to the lower pressure stage. Necessary cooling for this additional condensation may be provided by taking a stream of oxygen-enriched liquid from the bottom of the lower pressure stage, reducing its pressure and thereby reducing its temperature and heat exchanging the reduced pressure stream of oxygen-enriched liquid stream with the nitrogen to be condensed.

BRIEF DESCRIPTION OF THE DRAWING

An air separation plant according to the invention will now be described by way of example with reference to the accompanying drawing, which is a schematic flow diagram of an air separation plant and associated power generation plant.

The drawing is not to scale.

DETAILED DESCRIPTION OF THE INVENTION

Figure 1:
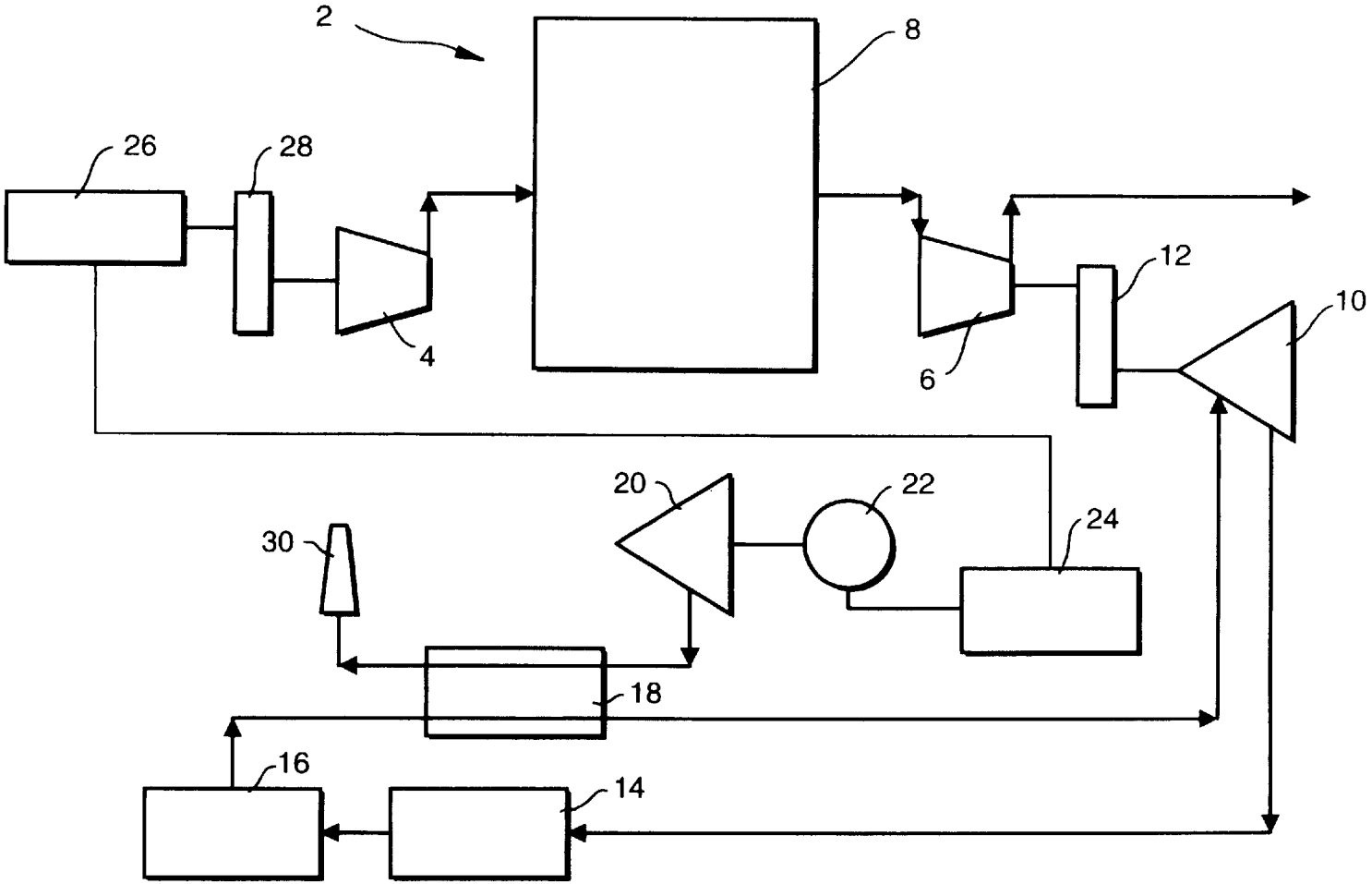

Referring to the drawing as shown an air separation plant 2, for the separation of air by rectification. The plant 2 provides a nitrogen product at elevated pressure. It includes a main air compressor 4, typically comprising a plurality of compression stages, and a nitrogen product compressor 6, also typically comprising a plurality of compression stages. For ease of illustration, the remaining parts of the air separation plant are represented in the drawing by a rectangular symbol indicated by the reference numbered 8 and need not be described further herein. They are all well known, and the invention primarily concerns the operation of the compressors 4 and 6.

The nitrogen product compressor 6 is driven by a steam turbine 10 typically through an arrangement of gears 12. The inlet and outlet pressures of the steam turbine 10 may be selected in accordance with amount of work of compression that the nitrogen compressor 6 has to perform. Typically the inlet pressure of the steam turbine 10 is in the range of 10 to 60 bar. Steam leaves the turbine 10 typically at a pressure in the range of 1.5 to 10 bar and flows to a condenser 14 in which it is condensed. The resulting condensate passes to a vessel 16 from which it is pumped at elevated pressure through a steam generator 18 of the heat recovery kind. Through operation of the steam generator 18, superheated steam is supplied to the turbine 10 at a desired pressure.

A gas turbine 20 is operated to drive a generator 22 of electrical power. The arrangement of the gas turbine 20 is conventional. That is to say it comprises an air compressor (not shown), a combustion chamber having an inlet communicating with the air compressor and another inlet communicating with a source of gas (typically natural gas) to be burned, and a turbo-expander (not shown) for expanding the gaseous products of combustion of the fuel gas.

The gas turbine 20 is mechanically independent of the air compressor 4, the nitrogen compressor 6, and the steam turbine 10.

The electrical power generated in the generator 22 is conveyed via a suitable electrical system 24 to an electric motor 26 which drives the main air compressor 4 typically via an arrangement of gears 28. Typically, a starter motor (not shown) is provided for the electric motor 26. The electrical system 24 is also arranged to provide electrical power to the starter motor.

The exhaust gases from the gas turbine 20 are heat exchanged in the steam generator 18 with the water to be raised to steam, thereby providing the necessary heat for the steam raising. Downstream of steam generator 18, the exhaust gases are vented to the atmosphere via a stack 30.

Various changes and modifications may be made to the plant shown in the drawing. For example, in the enhanced recovery of oil or gas it is typically desired to have a source of nitrogen available at a pressure in excess of 100 bar. Typically, to provide such a pressure a further plural stage nitrogen compressor (not shown) is used in series with the product compressor 6. The further nitrogen compressor may also be driven by the steam turbine 10 via a separate arrangement of gears (not shown). Alternatively, a further steam turbine (not shown) may be provided for this purpose and may be fed with pressurised super heated steam from the generator 18 and may return steam exhausting therefrom to the water condenser 14.

Typically, nitrogen is supplied to the product nitrogen compressor 6 at an elevated pressure in the range of 3 to 6 bar from the air separation plant 2. If desired, a further nitrogen stream may be supplied to an intermediate stage of the nitrogen compressor 6 from the air separation plant 2 at a pressure in excess of 10 bars.

What is claimed is:

1. An air separation plant including:

a product nitrogen compressor; and a steam turbine to drive said nitrogen compressor;

said steam turbine configured to operate in a cycle in which steam is raised by heat exchange of water with hot gaseous exhaust from a gas turbine which is adapted to drive an electrical generator arranged to supply electric power to a motor operatively associated with an air compressor forming part of the air separation plant.

* * * * *